United States Patent [19]

Bucknam

[11] 4,208,140

[45] Jun. 17, 1980

[54] AUTOMATED TYPEWRITER ATTACHMENT

[76] Inventor: Ralph E. Bucknam, Crescent Beach Dr., Huntington, N.Y. 11743

[21] Appl. No.: 902,927

[22] Filed: May 5, 1978

[51] Int. Cl.[2] ..... B41J 23/02

[52] U.S. Cl. ..... 400/171; 400/175

[58] Field of Search ..... 400/61, 151, 151.1, 400/171, 172, 174, 175, 469

[56] References Cited

U.S. PATENT DOCUMENTS

| | | | |
|---|---|---|---|
| 1,056,159 | 3/1913 | Emeliantzeff | 400/175 |
| 3,157,264 | 11/1964 | Frechette | 400/172 |
| 3,645,372 | 2/1972 | Noell et al. | 400/171 |
| 3,892,303 | 7/1975 | Willcox | 400/171 |
| 4,026,403 | 5/1977 | Inose et al. | 400/61 |
| 4,088,217 | 5/1978 | Bucknam | 400/175 X |

*Primary Examiner*—Ernest T. Wright, Jr.
*Attorney, Agent, or Firm*—Bucknam and Archer

[57] ABSTRACT

The device of the present invention is an automated version of an attachment for a ball element type typewriter intended to permit rapid automatic or semi-automatic switching among a plurality of ball elements. While the invention has utility in any instance where the need arises for switching rapidly and frequently among a number of ball elements, it is particularly useful in systems as described in U.S. Pat. No. 4,088,217 for utilization of a standard typewriter to type Chinese or Japanese.

7 Claims, 24 Drawing Figures

FIG. 1
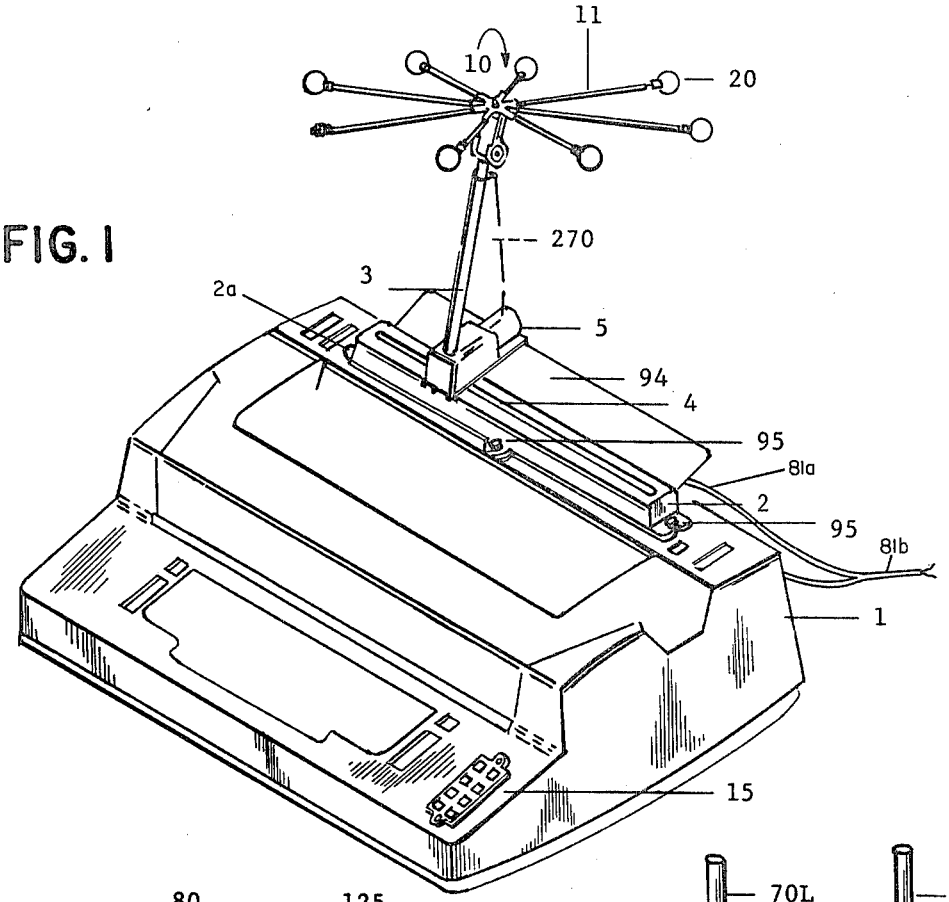
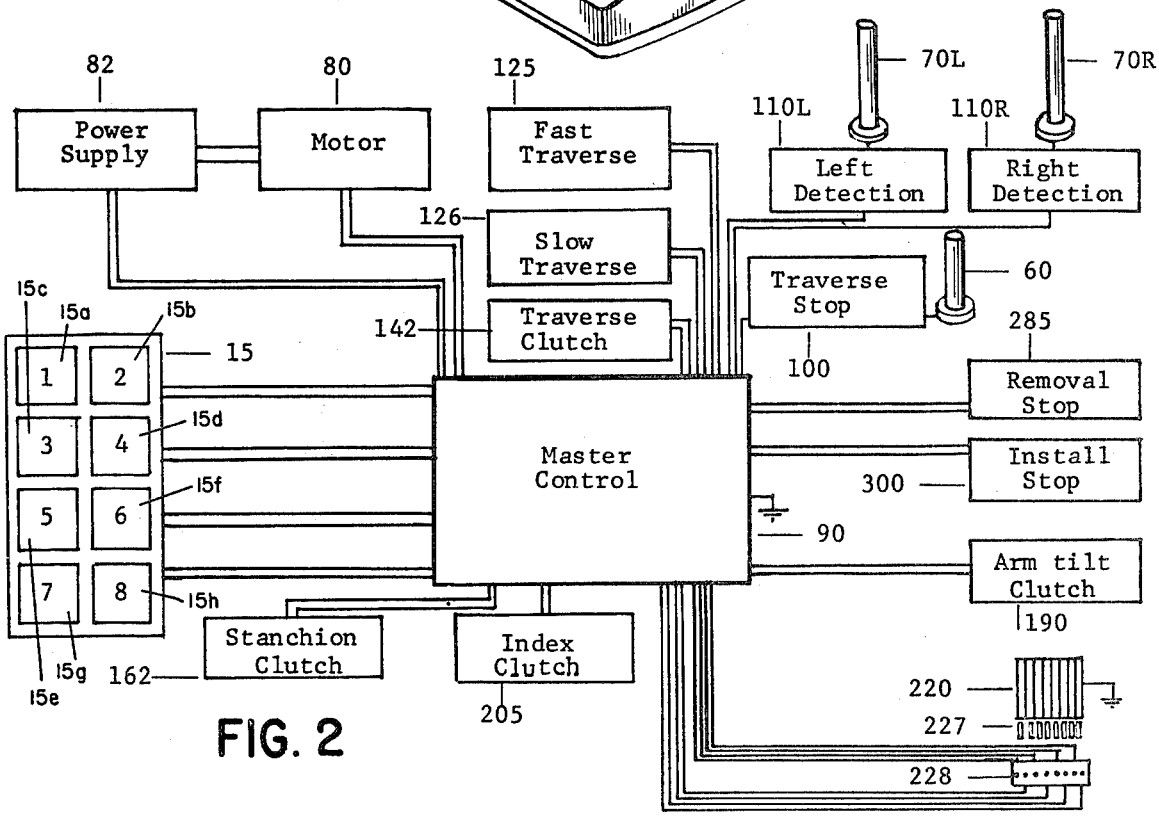
FIG. 2

AUTOMATED TYPEWRITER ATTACHMENT

SUMMARY OF THE INVENTION

The nature and substance of the invention resides in a device which may be quickly and firmly assembled to a standard ball-type typewriter, such as the one International Business Machines Corporation sells under the trademark "SELECTRIC II", with minimum modification of the typewriter structure or, alternatively, may be incorporated as a permanent part of the typewriter.

The present invention is an improvement in or modification of the typewriter attachment disclosed in U.S. Pat. No. 4,088,217 issued May 9, 1978 which comprises a ball support normally adapted to hold a combination of selected types of ball elements in a position clear of the area where the paper is moved and where the typing takes place. When a shift from one ball element to another is required, the device of that disclosure facilitates removing the presently operative ball element to a remote position, indexing the device quickly and accurately to permit rapid placement of another selected ball element in the operative position clear of the work, means being provided for adjusting the transverse position of the device to agree with the position of the operative ball element. It is noted that, by suitable gearing, this can be accomplished automatically.

While for many purposes, the extra expense and complexity of automation or semi-automation would probably not be justified, full automation is essential for utilization of the invention in devices such as tape or magnetic card operated typewriters and composers. Also, in any instance where speed of operation and minimum stress on the operator outweigh other considerations, a semi-automatic version in which the manual operation of a key or the like will implement the cyclic change will be of advantage.

The present invention pertains to a typewriter attachment of the above type in which operation may be either fully automatic or semi-automatic and which comprises means for initiating a cycle including the steps of traversing the ball support automatically in a linear transverse direction to a position in alignment with the position of an operative ball element, automatically removing the operative ball element, automatically indexing the ball support to place a selected ball element in position to replace the removed ball element, automatically assembling the selected ball element in typing position, and automatically moving the ball support to a position clear of the typing operation.

As has been explained in U.S. Pat. No. 4,088,217, while the invention has utility in various fields such as the typing of complex mathematical or chemical formulae, a particularly significant use is in the typing of the Chinese language. Detailed charts have been presented in that disclosure to demonstrate how the individual ball element can be prepared to accomplish this result. Also, minor modifications have been explained which permit the same utility to be realized in the typing of the Japanese language.

According to the present invention there is provided a device for changing ball elements on a typewriter of the moving ball type comprising motive means for traversing an assembly of ball elements in a linear direction transverse to the typewriter to a selected typing position, pivot means for causing an empty ball support member automatically to remove a ball from operative position on the typewriter, indexing means for automatically bringing another selected ball element into position for installation in said operative position, and means for again operating said pivot means to install said selected ball element in the operative position and returning the ball element assembly to a position clear of the typing area.

The invention also comprises a ball changing device including a ball support member having means thereon adapted to initiate installation and removal movements of a ball type typing element, means on the typing element for gripping the standard grooved stud in operative position, and means on the typing element responsive to activation by said ball support member when the stud has been gripped for releasing said grip and operative when the typing element is moved toward the stud for gripping the stud.

DRAWING

In order that the invention may be fully understood and readily carried into effect reference is made to the accompanying drawing in which:

FIG. 1 is a perspective view showing the device of the invention mounted on a standard typewriter.

FIG. 2 is a schematic circuit diagram showing the operational relationships among the parts.

Figure 11:
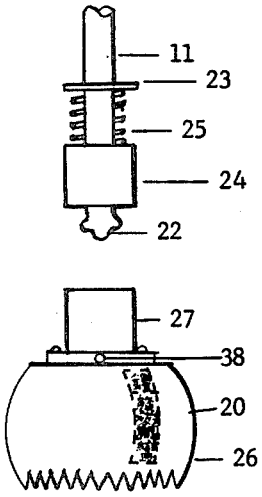
FIG. 11 shows a part of the ball changing interaction.
Figure 11:
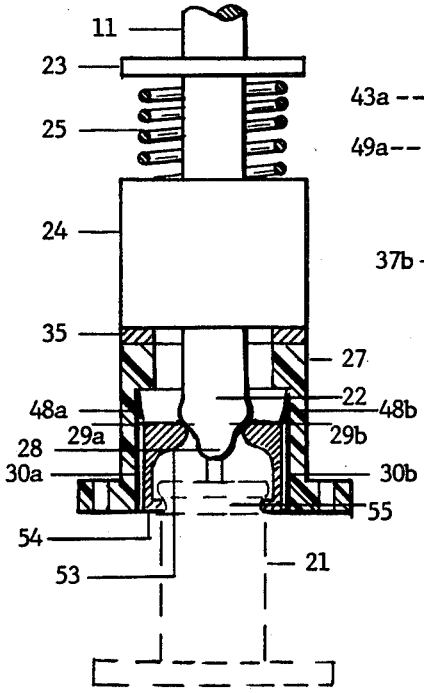
Figure 15:
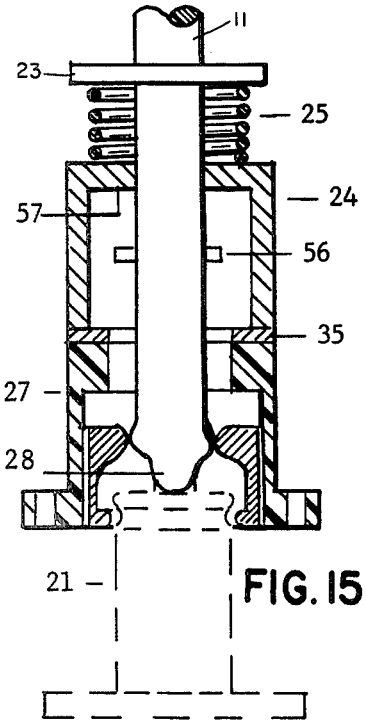
Figure 16:
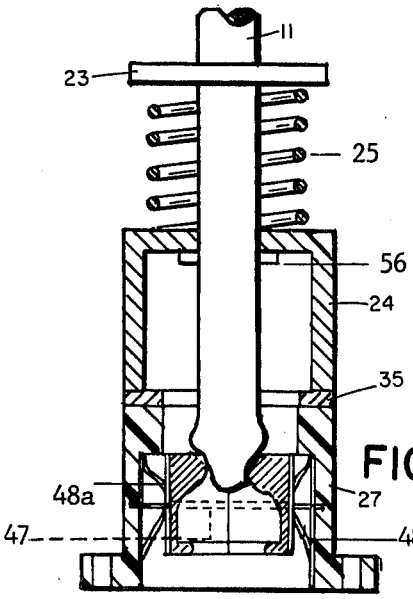

FIGS. 15 and 16 comprise views similar to FIG. 11 for demonstrating successive steps in the ball element changing operation.

DETAILED DESCRIPTION

Referring to FIG. 1 there is shown in perspective a drawing of a standard typewriter 1, in this case the IBM "SELECTRIC II" typewriter 1. Mounted on the typewriter 1 is a stanchion slide assembly comprising a slide box 2 and a stanchion 3 adapted to be moved along a slot 4 transversely of the typewriter 1 by a motor 5 carried on the slide box 2.

At the top of the stanchion 3 is mounted a ball support 10 comprising a plurality of support members 11 each adapted to carry a ball element 20.

Mounted on the typewriter 1 in convenient position for operation by the typist is a button assembly 15 carrying a separate button 15*a* to 15*h* (FIG. 2) identified with each support member 11 and adapted to initiate selected ball change movements.

As a preliminary step to the detailed explanation regarding the construction and operation of the device shown in FIG. 1, reference is made to FIGS. 10 to 16. In the initial showing of U.S. Pat. No. 4,088,217 the objective was to design a usable device with minimum change in existing commercial typewriter and ball-element design.

To achieve automatic or semi-automatic operation, as may be seen, for example, from U.S. Pat. No. 3,645,372 granted Feb. 29, 1972 to Noell et al, it becomes desirable to depart from standard design of the ball element 20. As can be seen from FIGS. 10 to 16, a particularly simple and unique structure and sequence of operations has now been discovered which not only has utility in automatic or semi-automatic operation but facilitates improved construction and operation of the manual device of U.S. Pat. No. 4,088,217.

Figure 10:
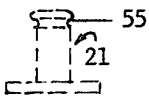
FIG. 10 shows the end of a ball support member, a ball element and the standard typewriter stud (in dash lines) all in spaced relationship.

FIG. 10 shows the ball support member 11, a typical ball element 20 and ball stud 21 in vertically spaced relationships, stud 21 being shown in dash lines since it is a permanent part of the standard typewriter 1.

On ball element 20 there are shown four typical Chinese characters in precisely the positions they might occupy on a ball element 20 designed for typing unabbreviated Chinese. The degree of intricacy of any Chinese character is accurately represented by the number of strokes required in this formation. The People's Republic of China has now standardized approximately 2400 characters. The most difficult character has 32 strokes. This is one of the characters shown on ball element 20. The other three characters as shown range from 28 to 30 strokes. The resulting print size is not unusual for Chinese printing.

The ball support member 11 has an operator probe 22 and a spring biasing flange 23 fixed to support member 11 at a predetermined distance above the end of probe 22. A ball-holding cylinder 24 formed of magnetic material is slidably mounted on support member 11 and a cylinder operating spring 25 positioned between flange 23 and cylinder 24 serves to force the cylinder 24 away from the flange 23.

The ball element 20 may comprise a printing component 26 which may be of standard conventional design and a novel ball cap 27 uniquely designed to cooperate with the ball support member 11 to place ball elements 20 on and remove ball elements 20 from stud 21. In FIGS. 11 to 16 the printing component has been omitted.

Figure 11A:
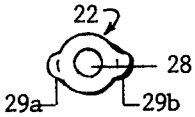
FIG. 11A is an end view of the ball support member.

FIGS. 11 to 16 are drawn to larger scale than FIG. 10 and show in detail the structure and technique for placing ball elements 20 on and removing them from stud 21. FIG. 11 shows ball cap 27 in the position in which it is secured to stud 21 for printing. FIG. 11A shows only the end view of operator probe 22 which comprises an end-point 28 and precisely formed activating projections 29*a* and 29*b* spaced with care a precise distance above end-point 28, as will be hereinafter more fully explained.

Figure 13A:
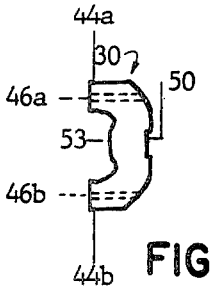
FIGS. 13A, 13B and 13C show respectively a top view, sectional side view and bottom view of the disabling element carried by the ball element.
Figure 13B:
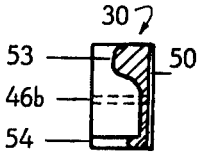
Figure 13C:
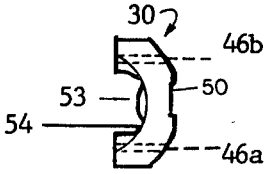

Bearing against the areas of support member 11 lying between projections 29*a* and 29*b* and end-point 28 are a pair of symmetrical ball engagement elements 30*a* and 30*b* one of which simply designated 30, is shown in detail in FIGS. 13A to 13C.

Figure 12A:
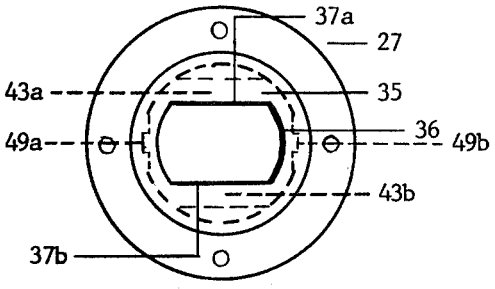
FIGS. 12A, 12B and 12C show respectively a top view, sectional side view and bottom view of a cap for the ball element of the invention.
Figure 12B:
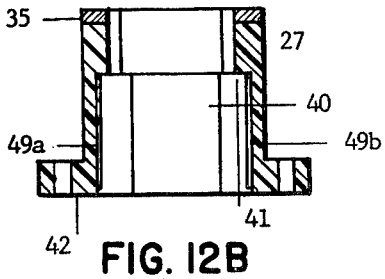
Figure 12C:
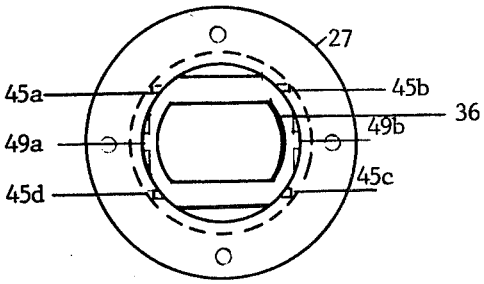

FIGS. 12A to 12C show respectively the top, sectional and bottom view of ball cap 27. Mounted on the top surface of the cap 27 is a ring 35 of magnetizable material adapted to be attracted with carefully determined predetermined force by magnetic ball holding cylinder 24. The remainder of ball cap 27 may be cast from an appropriate plastic. The probe entry aperture 36 of the cap 27 is circular at its end but flat on its sides 37*a* and 37*b* as shown in FIG. 12A, the distance between sides 37*a*, 37*b* being chosen so that operator probe 22 can enter the cap 27 only when activating projections 29*a* and 29*b* extend toward the circular ends of entry aperture 36. Appropriate means such as a red ambiguity prevention dot 38, as shown in FIG. 10, may also be provided to prevent 180° ambiguity when the ball elements 20 are assembled manually on ball support members 11.

As seen in FIG. 12B a ball engagement element receiving cavity 40 is provided in ball cap 27 with a shoulder 41 positioned a predetermined distance above the base 42 of the ball cap 27. Lateral recesses 43*a* and 43*b* are provided below aperture sides 37*a* and 37*b*. As can be seen from FIG. 13A, the two ball engagement elements 30 are roughly in the configuration of a semi-cylinder with flat sides 44*a* and 44*b* spaced so the ball engagement element 30 can slide up and down within ball engagement element receiving cavity 40, with the walls of lateral recesses 43*a* and 43*b* acting as guide members. To further assure that the respective ball engagement elements 30*a* and 30*b* do not tilt when they slide vertically, guide bar receiving grooves 45*a*, 45*b*, 45*c* and 45*d* are cast in the end walls of ball cap 27 as seen in FIG. 12C. Guide bar receiving channels 46*a* and 46*b* are cast (or drilled) in each ball engagement element 30 as seen in FIG. 13A. The elements 30 are preferably of metal so that drilling is appropriate in such case. They may however be made of a hard industrial plastic. As best seen in FIG. 16, the guide bars 47 each extend transversely between respective guide bar receiving grooves 45*a*, 45*b* or 45*c*, 45*d*, and through respective guide bar receiving channels 46*a*, 46*b*, the tolerances being chosen to permit free transverse and vertical movement of ball engagement elements 30*a*, 30*b*, but preventing substantial tilt of one with respect to the other. For convenience, guide bar 47 has been shown in FIG. 16 with exaggerated length to illustrate how it extends into the side walls of ball cap 27. The actual length, obviously, will be determined by the spacing of guide bar receiving grooves 45*a* to 45*d* as shown in FIG. 12C.

Ball engagement elements 30*a* and 30*b* are urged toward each other by strong element bias springs 48*a*, 48*b* best seen in FIG. 16. As can be seen in FIGS. 12A to 12C, grooves 49*a* and 49*b* are cast in the ball cap 27 to receive springs 48*a* and 48*b*, and a spring track 50 is provided in the back of each ball engagement element 30 as shown in FIGS. 13A to C for guiding the elements 30 vertically along the spring 48*a*, 48*b*.

At the top inside surface of each ball engagement element 30 there is provided a probe activating projection follower 53 and at the bottom inside surface there is provided a stud grip 54 which, as shown in FIG. 13C is of arcuate configuration along the width of the ball engagement element 30. The stud grip 54 is shaped to engage firmly the standard stud groove 55 shown in FIG. 10.

FIG. 11 shows the ball cap 27 in position to hold the ball element 20 in operative position on stud 21. The stud grips 54 are snugly seated in stud groove 55 and springs 48*a* and 48*b* are urging the ball engagement elements 30*a* and 30*b* toward each other.

The end point 28 of operator probe 22 has been brought into position for initiating the ball removal operation. Spring 25 is slightly compressed and activating projections 29*a* and 29*b* are beginning to bear against probe actuating projection followers 53.

In FIG. 15 spring 25 has been forced into fully compressed position and end point 28 of ball support member 11 has moved downward into engagement with stud 21. Activating projections 29*a* and 29*b* have spread apart ball engagement elements 30*a* and 30*b* by applying pressure on probe actuating projection followers 53, and stud grips 54 have moved outwardly to a position clear of stud groove 55. The ball element 20 is now free to be removed by ball support member 11 from stud 21. As ball support member 11 is withdrawn upwardly, spring 25 will extend until spring stop pin 56, extending diametrically through ball support member 11, comes into engagement with a top 57 of magnetic ball holding cylinder 24 as shown in FIG. 16. At this stage the ball element 20 is lightly but firmly held in position on a ball support member 11 due to the interaction between magnetic ball holding cylinder 25 and magnetizable ring 35. The ball element 20 will remain in this position until the operation of again installing it on stud 21 is initiated.

Figure 14B:
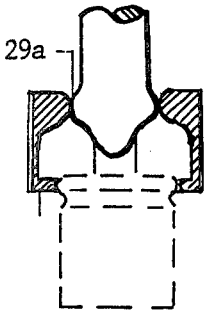
FIGS. 14 shows three stages (a), (b) and (c) of the ball element insertion operation.
Figure 14A:
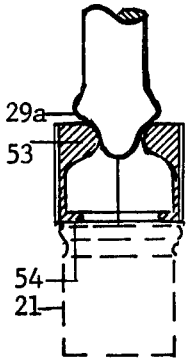
Figure 14C:
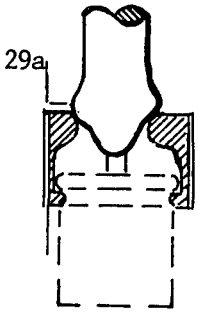

FIG. 14 shows three successive stages (a), (b) and (c) of installation of a ball element 20 on stud 21. In stage (a) end point 28 is in precisely the position shown in FIG. 16. In stage (b) it has been lowered precisely to the point where probe actuating projection followers 53 will be spread to the point where stud grips 54 bear against the outer side of stud 21, this position being achievable because, in the transition from stage (a) to stage (b), the bottoms of stud grips 54 have established pressure against the top of stud 21. When stage (b) is reached, so that such pressure no longer exists, the strong force of springs 48*a* and 48*b* on ball engagement elements 30*a* and 30*b*, together with slight continuing downward pressure from ball support member 11 will cause stud grips 54 to slide downwardly into engagement with stud groove 55, and the ball element 20 is assembled in operative position as indicated in stage (c).

As ball support member 11 is withdrawn upon achievement of stage (c), there will be conflict between the force of springs 48*a* and 48*b* which hold the stud grips 54 in stud groove 55 and the magnetic force between magnetic ball holding cylinder 24 and magnetizable ring 35 which tends to pull stud grips 54 away from groove 55. It is necessary to design springs 48*a*, 48*b* and the magnetic components so the spring force will unquestionably prevail and cylinder 24 will separate from ball cap 27, thus leaving ball support member 11 empty until it is called on to make the next ball element withdrawal.

The device and technique as shown and described is adaptable for use either with the manual system of U.S. Pat. No. 4,088,217 or the automatic or semi-automatic system now to be described. In the manual operation, there will be two distinct "feels" as the ball support member 11 is manually moved into the ball cap 27. For the ball removal operation as depicted in connection with FIGS. 11 and 15, the end point 28 must be depressed firmly until one feels its contact with stud 21 as shown in FIG. 15. For the ball insertion operation as described in connection with FIG. 14, the ball support member 11 is moved gently downwardly until the stud grips 54 are felt to slide into stud groove 55. Care must be taken not to use such pressure as will bring end point 28 into engagement with the top of stud 21 in the ball insertion operation. As will be described, these two distinctive operations can be achieved mechanically by causing the ball support member 11 to move through a predetermined longer path for ball removal than for ball installation.

Figure 3:
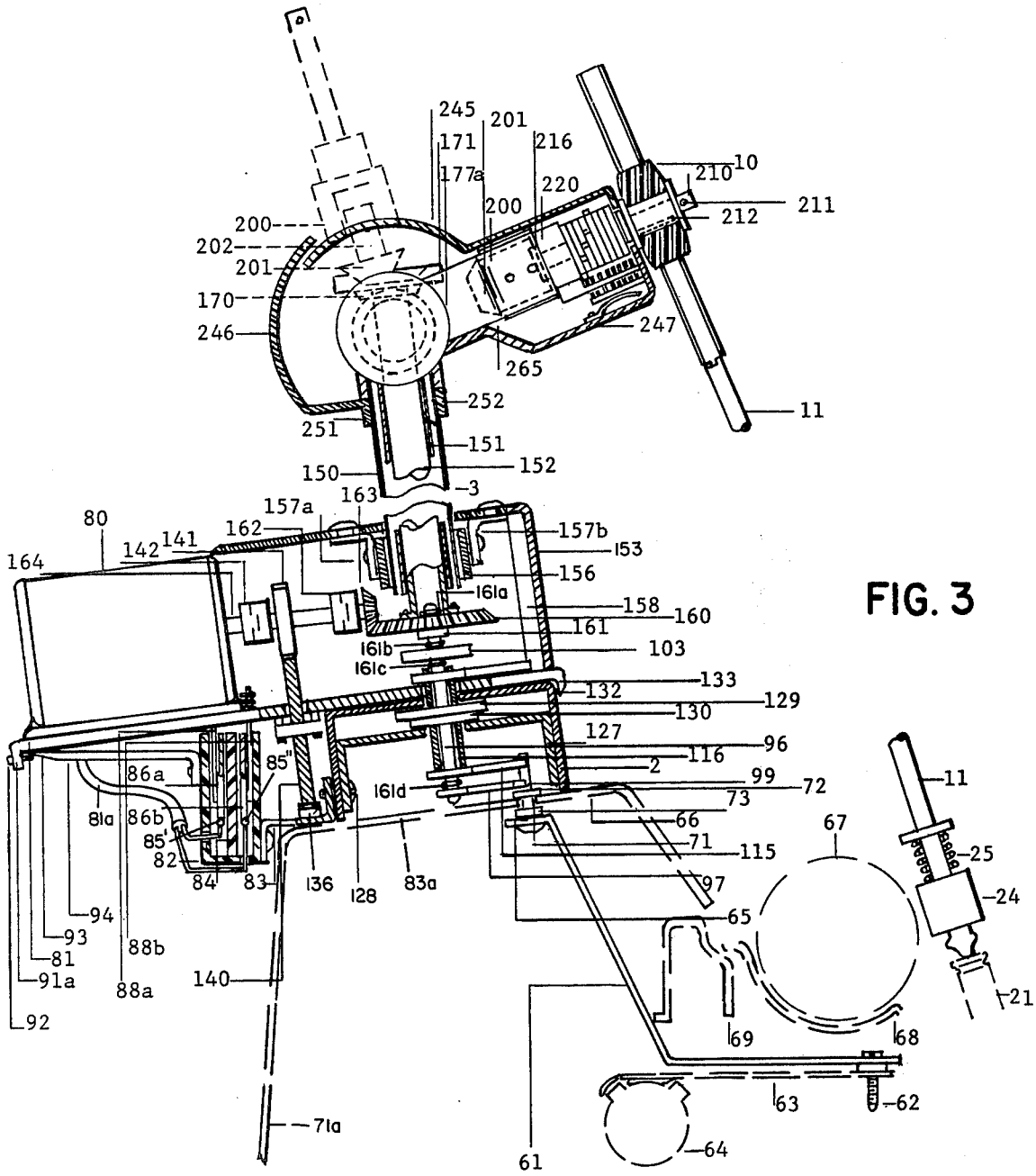
FIG. 3 is a side view of the device of the invention as mounted on a standard typewriter, the later being shown in dash lines. Most of the parts are in section.
Figure 5:
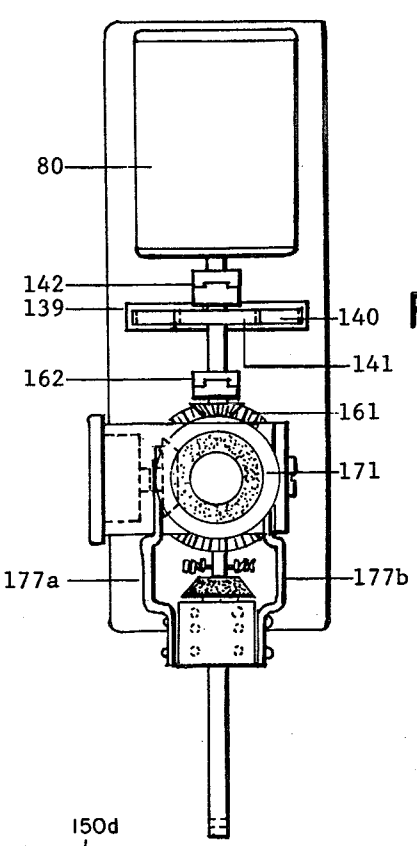
FIG. 5 is a top view prepared on the same basis as FIG. 4.
Figure 4:
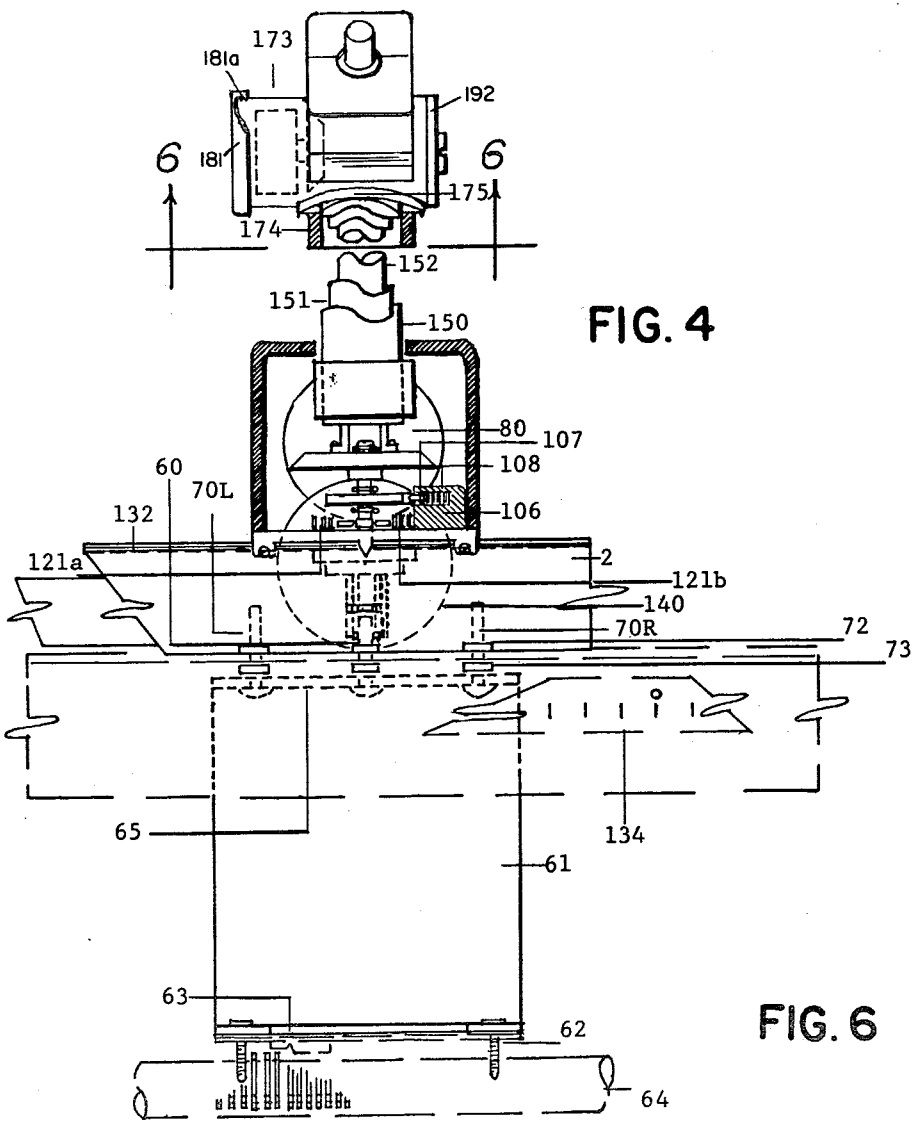
FIG. 4 is a front view prepared on the same basis as FIG. 3 but with certain parts omitted.

In designing the automatic or semi-automatic structure the goal has been to provide a device requiring minimum modification of the existing prototype typewriter 1. The first problem to be solved is the effecting of the transverse movement of the ball assembly along slot 4. This calls for devising a column alignment stop 60 as shown in FIG. 4 which must move transversely in unison with some moving part of the standard ball-element carrier of such prototype typewriter 1. One simple solution is to provide a strong, light drive member 61 as shown in FIG. 3 which may be attached by the same carriage screws 62 as hold the standard escapement arm 63, shown in dash lines in FIG. 3, to the ball carriage. The drive member 61 may be formed to pass up over the standard tab rack 64, also shown in dash lines in FIG. 3 and may have a stop-supporting surface 65 disposed parallel to the top rear surface 66 of the typewriter 1, also disclosed in dash lines. The drive member 61 passes under the typewriter roll 67, the paper guide 68, and A-frame 69.

The column alignment stop 60, together with two spaced detection stops 70 shown as left detection stop 70L and right detection stop 70R in FIG. 4 are mounted on stop supporting surface 65 and disposed to move along a slot 71 cut transversely in top rear surface 66 of the typewriter 1. Suitable slide washers 72, 73 are provided on each of the three stops 60, 70L and 70R above and below the slot 71 in the typewriter cover 71*a*. As the ball element 20 moves transversely of the typewriter 1 during the typing operation, these three stops 60, 70L and 70R move in unison therewith.

It is desirable that the stanchion 3 should remain stationary until called upon to effect a change of ball elements 20. Such change is effected by pushing a selected button 15*a* to 15*h* of button assembly 15. In the embodiment shown, provision is made for eight ball support arms 11, and the circuit diagram of FIG. 2 shows eight buttons 15*a*–15*h* comprising the button assembly 15.

Motor 80 serves, upon actuation of a selected button 15*a*–15*h*, to move stanchion 3 to a position in alignment with column alignment stop 60. Motor 80 is mounted on tray 81. A branch power line 81*a* may be led from the standard power line 81*b* of the typewriter 1 to a power box 82 mounted by brackets 83 onto the back top cover 83*a* of the typewriter 1. Power box 82 should be formed of insulating material and should be provided with an insulating partition 84 extending vertically along the center thereof.

Throughout the remaining description reference will be made extensively to FIG. 7 which shows an exploded, isometric view of most of the parts. As best seen in that view, power terminal bars 85*a* and 85*b* are mounted on opposite sides of insulating partition 84. Contacts 85' and 85'' may be soldered or otherwise attached to respective terminal bars 85*a* and 85*b* for attaching branch power line 81*a* thereto. Two power take-off wheels 86*a*, 86*b* are provided. Each is supported in respective insulated passages 87*a*, 87*b* in tray 81 by respective conductor bars 88*a*, 88*b*. From these conductor bars 88*a*, 88*b* power is led to the motor 80 and to a master control 90 as shown diagramatically in FIG. 2. The rear margin of the tray 81 may be provided with two anti-tilt lugs 91*a*, 91*b* each provided with set screws 92 adapted to engage the lower lip surface 93 of a rear support bracket 94 (also shown in FIG. 1) secured to power box 82 and tapering upwardly to a line at the rear. Bars 88*a* and 88*b* are biased upwardly by springs 74*a* and 74*b*.

The structure carrying tray 81 is substantially the same as disclosed in U.S. Pat. No. 4,088,217. As seen in FIG. 1, slide box 2 is provided with flanges 2*a* secured to the top cover 83*a* by three knurled screws 95, one at the center and one at each end. Slot 4 extends along the top as shown in FIG. 1, and an assembly of parts associated with stanchion 3 extend through said slot 4 and operate as now to be described.

On the inner axis of the stanchion assembly column, alignment stop bar 96 extends downwardly to a position just short of top rear surface 66 of the typewriter top cover 71*a*. Column alignment sensor arm 97 is secured by set screw 98 to bar 96 near its lower end and extends forwardly so that stop receiver 99, best seen in FIG. 7, will partly surround column alignment stop 60 when stanchion 3 is precisely aligned transversely with said column alignment stop 60. At this point, circuitry (not shown) sends an alignment signal to transverse stop 100 shown diagramatically in FIG. 2.

Tray 81 is provided with aperture 101 through which the stanchion assembly passes. Spaced above tray 81 and mounted on column alignment bar 96 by set screw 102 is sensor arm position control member 103 comprising a transversely extending portion terminating in a centering aperture 104 and left and right biasing apertures 105L and 105R. Mounted in a housing 106 adapted to be secured to tray 81 is a bias pin 107 urged by a spring 108 into selective engagement with apertures 104, 105L or 105R. The step receiver 99 will be carried to the left or to the right depending on the direction of movement. Sensor arm position control member 103 will be swung through a sufficient arc in one direction or the other so that sensor bias pin 107 will engage one or the other of left and right biasing apertures 105L or 105R and hold the assembly in this extreme position until stanchion 3 is again transversely aligned with column alignment stop 60. When the bias pin 107 is in either of the respective extreme positions corresponding circuitry left detection 110L or right detection 110R as shown in FIG. 2, will be activated by control member 103. Upon return of pin 107 to the central position, the circuitry will be deactivated. Thus, when a button 15*a*–15*h* is pushed in assembly 15 calling for traversing of stanchion 3, the direction of movement will have been predetermined.

To ensure efficient operation it is desirable that the transverse movement of the stanchion 3 be at a rapid rate when more than a predetermined distance is to be covered but that movement be slowed down at some point so that the final approach to column alignment stop 60 can be at a controlled rate. To achieve this result, speed control arm 115 is mounted on a tubular member 116 rotatably surrounding column alignment stop bar 96 and extending through tray aperture 101. Attached by set screw 118 to tubular member 116 is speed control centering arm 119. Speed bias housings 120*a* and 120*b* shown in FIG. 7 but not in FIG. 2, are mounted on tray 81 and carry compression springs 121*a* and 121*b* which bear against plungers 122*a* and 122*b* to bias speed control arm 119 to a central position. As speed control arm 115 moves past either the left or right detection stop 70L or 70R in a direction away from column alignment stop 60, it comes in contact therewith and, due to its position, will activate fast traverse 125 shown in FIG. 2. As speed control arm 115 comes in contact with right or left detection stop 70L or 70R while moving in the reverse direction, it will deactivate fast traverse 125 and activate slow traverse 126 due to its new position. Thus, the desired change in speed of traverse is insured.

To ensure the stability of stanchion 3 an annular guide member 127 is secured by screw 128 to the inside of slide box 2, and a Teflon washer 129 is held in sliding engagement with the underside of box 2 by threaded washer 130. As shown in FIG. 7, lugs 131*a* and 131*b* (not illustrated) may be provided along the front edge of tray 81. A bead 132 may be formed along the top front side of box 2, and set screws 131′ (see FIG. 7) extending through lugs 131*a* and 131*b* may engage the bottom surface of bead 132 to prevent backward tilt. A pointer 133 may be included on the front edge of the tray 81 and may be used in conjunction with the standard scale 134 a fragment of which is shown in FIG. 4 mounted on the front side of slide box 2.

Along the lower rear surface of slide box 2 there is mounted a track angle 135 which carries a gear track 136. Beneath tray 81 an axle 137 is mounted in brackets 138*a* and 138*b*. A gear slot 139 is provided in tray 81 and traverse gear 140, mounted on axle 137, passes through slot 139 and engages track 136.

Motor 80 is coupled to traverse drive gear 141 by traverse clutch 142 and drive gear 141 meshes with traverse gear 140 to produce the desired traverse movement of stanchion 3. Circuitry is provided as hereafter described for disabling traverse clutch 142 when stop receiver 99 is in alignment with column alignment stop 60

It will be noted from FIG. 1 that one ball support member 11 has no ball element 20 mounted thereon. Normally, the ball element 20 in operative position will have been installed therein by this support member 11, and it remains in position to remove the ball element 20 by a downward tilting motion followed by a reverse motion. The next step is to achieve this result.

The stanchion 3 comprises an outer tube member 150, an intermediate tube member 151 and an inner tube member 152. A circuit housing 153 is mounted on tray 81 with an opening 154 in one end adapted to fit snugly against motor 80. An orifice 155 is provided to permit passage of outer tube member 150 upwardly through the housing 153. A collar 156 is provided for surrounding outer member 150 within the housing 153 and providing support therefore, and brackets 157*a* and 157*b* serve to support collar 156 from the underside of housing 153. The front end 158 of the circuit housing 153 may be recessed so as to receive prefabricated components of master control 90.

A stanchion rotation gear 160 has a collar 161 secured to the top portion of column alignment stop bar 96 and gear 160 is free to rotate on said collar 161. A plurality of spring rings 161*a* to 161*d* may be mounted in indentations of said stop bar 96 as shown to preserve the desired spacing of components. The inner tube 152 is secured to the top of stanchion rotation gear 160 so as to rotate therwith.

Simultaneously with the disengagement of traverse clutch 142, a stanchion clutch 162 is engaged to cause motor 80 to operate stanchion drive gear 163 by means of motor shaft 164. At the top of inner tube member 152 are mounted tilt bevel drive gear 170 and friction cone 171.

Stationary outer tube member 150 is provided at its top with a pair of very short sleeves **172*a* and 172*b* whose purpose will be subsequently explained. The top portion extends into a cylindrical tilt mechanism housing 173 so that an axis drawn through sleeves 172*a* and 172*b* will coincide with the axis of the cylinder. A downwardly extending stanchion receiving collar 174 fits over outer tube member 150 and has a flange 175 at its top shaped to conform with and secured as by weldng to tilt mechanism housing 173**.

Cut into tilt mechanism housing 173 are tilt slots **176*a* and 176*b* respectively adapted to receive tilt brackets 177*a* and 177*b*. Aligned along the left branch of tilt mechanism housing 173 as seen in FIG. 7 are in sequence driven tilt bevel gear 178, tilt axle 179, tilt clutch solenoid 180 and tilt housing cap 181, the later having an internally threaded flange 181*a* (see broken away portion in FIG. 4) adapted to be screwed onto threads 182 of tilt mechanism housing 173**.

It will be noted that the right end of tilt axle 179 is designed to be rotatably received in sleeve **172*a* of outer tube member 150. Adjacent the right end there is provided a cubical section 184 and driven tilt bevel gear 178 is provided with an aperture 185 of square cross section adapted to be fixed securely on cubical section 184 in close proximity to sleeve 172*a*. In this position driven tilt bevel gear 178 will mesh with tilt bevel drive gear 170. Tilt bracket 177*a* is also provided with a similar aperture 186 of square cross section also adapted to fit over cubical section 184 in spaced relationship to driven tilt bevel gear 178. When in its meshing position, tilt axle 179 may be adapted to slide in square aperture 186. In the thus assembled condition, the space between the inner surface of tilt bracket 177*a* and the adjacent outer surface of driven tilt bevel gear 178 should be just adequate to permit complete withdrawal of bevel gear 178 from meshing engagement with tilt bevel drive gear 170. The left end of tilt axle 179 as seen in FIG. 7 is adapted to slide through a central orifice 187 in tilt clutch solenoid 180. As seen diagramatically in FIG. 2 circuitry identified as arm tilt clutch 190 is provided for applying one polarity to tilt clutch solenoid 180 to force tilt axle 179, which serves as an armature, to move driven bevel gear 178 into meshing engagement with tilt bevel drive gear 170 and for applying a reverse polarity to the soleniod 180 for withdrawing bevel gear 178** from meshing engagement.

Figure 7:
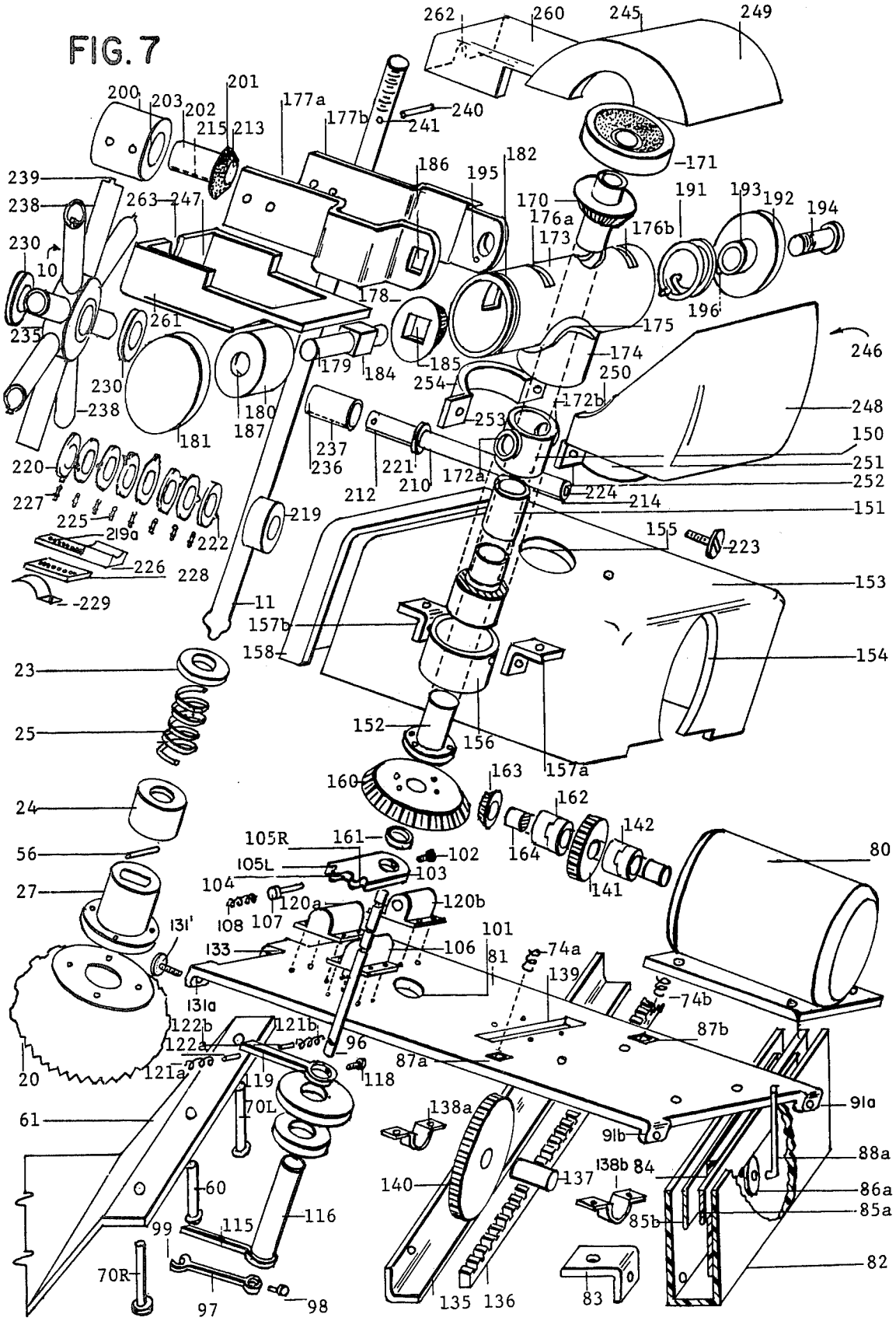
FIG. 7 is an exploded isometric view of most of the important parts of the device showing their relationship to each other.

On the right side of tilt mechanism housing 173 as seen in FIG. 7 is a restoring torque spring 191 and an end cap 192 having a spring positioning sleeve 193 thereon and a cap securing screw 194 adapted to be threadedly engaged in sleeve **172*b* so as to hold end cap 192 against rotation. One end of spring 191 is engaged in aperture 195 of tilt bracket 177*b* and the other end is engaged in aperture 196 in end cap 192 so that bracket 177*b* is biased in a clockwise direction as seen in FIG. 7**.

Mounted as by rivets or screws between the extreme ends of tilt brackets **177*a* and 177*b* is index clutch solenoid 200 carrying index bevel drive member 201 provided with a rough friction surface as hereinafter explained. Drive member 201 is carried on an armature 202 adapted to fit in a cylindrical opening 203 of index clutch solenoid 200. During tilting operation, a voltage will be imposed on solenoid 200 by a circuit indicated diagramatically in FIG. 2 as index clutch 205 which will draw armature 202 into armature opening 203. When indexing is required, as hereinafter discussed, a voltage of opposite polarity will be imposed on solenoid 200 to force armature 202 away from armature opening 203**.

As can be seen in FIG. 3 ball support 10 is carried on a ball support indexing shaft 210 having a pin receiving passage 211 adapted to receive a pin which can easily be removed and reinserted for changing ball assemblies. A spline 212 is provided on shaft 210 for cooperating with ball support 10 as hereinafter described to prevent rotation of ball support 10 on shaft 210. The other end of shaft 210 extends into a cylindrical shaft receiving opening 213 in armature 202 and serves as a guide for sliding movement thereof. Spline 214 on shaft 210 fits into a groove 215 in armature 202 to prevent relative rotation. A threaded flange member 216 with threads opposing the direction of indexing rotation may be screwed on shaft 210 so as to bear against the inner transverse wall of solenoid 200 and prevent axial movement of shaft 210. A spacer member 219 and a ball support index contact assembly 220 are interposed between index clutch solenoid 200 and a flange 221 fixed on shaft 210.

The purpose of the ball support index contact assembly 220 is to transmit to master control 90 signals indicating the angular positions of respective ball elements 20 on the ball support 10, as shown in FIG. 2, as it rotates with shaft 210. As can be seen from FIG. 7 and FIG. 6A, eight discs are provided each having an index contact 222 disposed at intervals of $\pi/4$ radians. These discs are mounted so as to rotate with shaft 210. The purpose of spacer member 219 is to provide flexibility for design to meet varying length of shaft requirements for different types of typewriters. A screw 223 may be fit into a threaded orifice 224 in the end of shaft 210 to limit the axial movement of armature 202 thereon.

For indexing operation, the eight contacts 222 are adapted to operate eight respective detector pins 225 as seen in FIG. 7. A guide member 226 is arranged to fit on the bottom of spacer member 219 and is provided with eight guide holes **219*a* (a typical one being designated in FIG. 7) through which the detector pins 225 project upwardly. The detector pins 225 are each provided with a small flange or enlargement 227 which limits their upward motion in guide member 226. A contact base 228 is positioned at the lower end of the pins 225 and is biased upwardly by a leaf spring 229. Eight orifices are provided in the contact base 228 and, when a particular contact pin 225 is forced downwardly there through by a downwardly extending index contact 222, a selected one of eight unique circuits is completed from ball support index contact assembly 220 to master control 90 as shown in FIG. 2**. In this case, the return is preferably through ground as shown.

It is advisable to include on each side of the ball support 10 a washer 230. The ball support 10 itself may advantageously comprise a plastic hub 235 non-rotatably mounted on a sleeve 236 having therein a groove 237 adapted to receive spline 212 on shaft 210. The hub 235 has eight equally spaced socket members 238 extending radially outwardly therefrom, each internally threaded to receive a ball support member 11. Each socket member 238 has an axially projecting portion 239 adapted to engage a pin 240 extending from an orifice 241 in the ball support member 11 and to determine precisely the final circumferential relationship between the socket member 238 and the ball support member 11 when screwed into said socket member 238. FIG. 3 shows the end portion of a typical ball support member 11 in final position for ball removal with respect to stud 21, no ball element 20 being shown.

The casing surrounding the tilt mechanism housing 173, the tilt brackets 177*a* and 177*b* and associated parts may comprise three components, a top section 245, an end section 246, and a bottom section 247. The casing end section 246 has an arcuate surface 248 adapted to receive a corresponding arcuate surface 249 of the top section 245. A section 250 of each side of end section 246 is curved to fit snugly against tilt mechanism housing 173 and a semi-circular collar section 251 is provided with a pair of flanges 252 adapted to be bolted to flanges 253 of a complimentary collar section 254 so that the pair of collar sections 251, 254 fit firmly on outer tube member 150 as shown in FIG. 3.

Figure 6A:
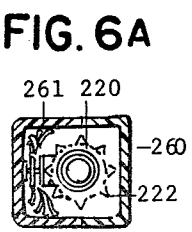
FIG. 6A is an end view of certain parts of the device as shown in FIG. 6.

The ends 260 and 261 of the top section 245 and bottom section 247 are designed to form a box with greater depth in the bottom section 247 than on the top section 245 as seen in FIG. 6A. Each section 245, 247 has a semicircular recess 262, 263 adapted to fit in clearing relation transversely of tilt shaft flange 221. As seen in FIG. 3, bottom section 247 slopes upwardly toward tilt brackets 177*a* and a wire clearance area 265 is provided between the bottom section 247 and index bevel drive member 201 for reasons now to be explained.

The problem of wiring the structure requires careful consideration. In FIG. 1 an auxilliary casing 270 is shown in dash lines. It may in some instances be advantageous to add such casing 270 not only for asthetic reasons but to provide added rigidity to stanchion 3 and afford additional room for leading signal conduits downwardly to master control 90. Fundamentally, however, such casing 270 is not necessary. As seen in FIG. 3, a substantial space is provided between outer tube member 150 and intermediate tube member 151, the purpose being to provide room for conduits. If there is a problem of preventing rotation of intermediate tube member 151 this may be dealt with by attaching it with a screw (not shown) to outer tube member 150.

Figure 6:
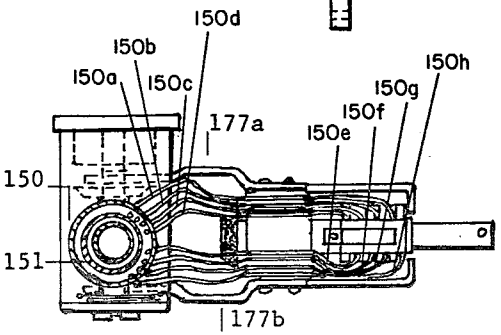
FIG. 6 is a sectional view taken along the line 6—6 of FIG. 4.

FIG. 6 shows eight conduits 150*a* to 150*h* emerging from the top of this space and illustrates how they may be routed along the area beneath tilt brackets 177*a* and 177*b* and past index solenoid 200 to contact base 228. The purpose of the extra depth of bottom section end 261 is to permit accumulation of sufficient loose wire so that movement of the ball support assembly between the lower to upper positions as shown in FIG. 3 will not impose any stress on the conduits 150*a*–150*h*.

Figure 8:
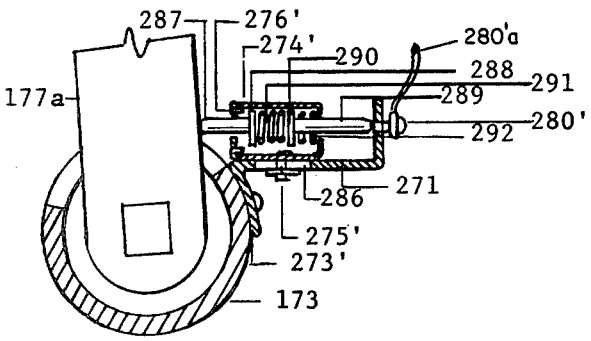
FIGS. 8 and 9 are sectional side views of two stop mechanisms for determining points of insertion and release of the ball element in the typewriter.
Figure 9:
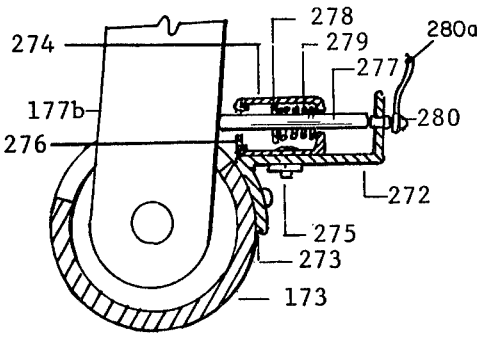

FIGS. 8 and 9 show respective stop switches 271 and 272 for producing less movement of ball support member 11 in installing a ball element 20 on stud 21 than in removing the ball element 20 therefrom, as heretofore discussed. While ball element installment switch 271 and ball element removal switch 272 have been shown in horizontal position for convenience in drawing, they will in practice extend angularly downwardly, the bottoms of tilt brackets 177*a* and 177*b* in practice being in the position shown in FIG. 3.

Ball element removal switch 272 is mounted on a bracket 273 secured by screws or rivets to tilt mechanism housing 173. Switch housing 274 is secured on bracket 273 by bolt 275 and has a front stop disc 276 threadedly mounted therein. A switch pin 277 is adapted to move backward and forward through an orifice in front disc stop 276 within the limits permitted by switch pin flange 278 mounted on pin 277 and a spring 279 interposed between the rear end of housing 274 and flange 278.

The rear surface of bracket 273 extends upwardly and a contact pin 280 is mounted therein and connected to a conduit 280*a* as shown. Switch pin 277 passes through an orifice in the rear wall of housing 274. Pins 277 and 280 are positioned to make contact at the precise moment when point 28 of ball support member 11 touches stud 21 as shown in FIG. 15. Appropriate circuitry diagramically shown as removal stop 285 in FIG. 2, will send a control signal to master control 90 at this instant.

Several parts of the installment mechanism of FIG. 8 are sufficiently similar to what has been described that it is adequate simply to identify such parts with primes of numbers already given rather than redescribing them. One essential difference is that the bolt 275′ of FIG. 8 fits in a slot 286 permitting careful adjustment. The objective is to generate a signal at a precisely determined position before tilt bracket 177*a* has completed its full downward swing. This is for the purpose of stopping the downward swing of ball support member 11 when it has reached the position shown in FIG. 14 (*c*) rather than permitting it to go the full distance as shown in FIG. 15. To accomplish this objective, a control pin 287 having a flange 288 and a contact pin 289 having a flange 290 are substituted for pin 277 of FIG. 9. A contact spring 291 is interposed between flanges 288 and 290 and a restoration spring 292 is interposed between flange 290 and the back wall of housing 274′. Thus, in advance of the full downward swing, contact 280′ will be closed to send an appropriate signal through conduit 280′*a* to master control 90 by way of the diagramatic circuit designated install stop 300 in FIG. 2.

OPERATION

Referring to FIGS. 1 and 2 suppose the ball element 20 being used in the typewriter 1 is identified with button No. 1 of button assembly 15 so that the corresponding ball support member 11 will be the one shown as empty in FIG. 1. Also, suppose stanchion 3 is at rest in a position substantially to the left as seen in FIG. 1 and, at the moment a ball element 20 is at a position to the right of the center of the typewriter 1.

Suppose the desired change is to install the ball element No. 5 which is diametrically opposite the empty ball support member 11 in FIG. 1 and which is identified with button No. 5 of button assembly 15. Left Detection 110L and Fast Traverse 125 will be operative in the circuitry of FIG. 2. Button No. 5 will signal Master Control 90 to check that Power Supply 82 is turned on. Assuming this is the case, Master Control 90 will signal Motor 80 to rotate traverse drive gear 141 through traverse clutch 142 with resultant rotation of traverse gear 140 in a direction to move stanchion 3 toward the right at a rapid rate.

As soon as speed control arm 115 comes in contact with left detection stop 70L, Master Control 90 will render Fast Traverse 125 inoperative and will activate Slow Traverse 126. Consequently, a signal will be sent through Master Control 90 to Motor 80 to slow its speed in preparation for an accurate stop.

When stop receiver 99 of column alignment sensor arm 97 initially contacts the side of column alignment stop 60 Traverse Stop 100 will transmit a warning signal to Master Control 90, and Master Control 90 will initiate the final stopping of Motor 80. When column alignment sensor arm 97 embraces column alignment stop 60, a second signal will be sent by Traverse Stop 100 to Master Control 90, and Master Control 90 will open Traverse Clutch 142 and terminate the rotation of Motor 80.

Upon termination of rotation of Motor 80, Master Control 90 will engage Stanchion Clutch 162. Arm tilt Clutch 190 will be in operative condition as a result of action terminating the previous ball element change. Master Control 90 will test the circuitry to ensure that this condition exists. Assuming it does, Master Control 90 will transmit a signal to Motor 80 to rotate in what may be termed standard stanchion drive direction.

Upon Motor 80 thus being actuated, with the circuit of Stanchion Clutch 162 closed, stanchion drive gear 163 will rotate stanchion rotation gear 160 and inner tube member 152 with resultant rotation of tilt bevel drive gear 170 and friction cone 171. As a result of the previous ball element installation index solenoid clutch 200 will be holding index bevel drive member 201 in retracted position. Master Control 90 will check the circuitry of Index Clutch 205 to ensure that this condition exists. Thereupon, tilt bevel drive gear 170 will rotate tilt bevel gear 178 in a direction to lower empty ball support member 11 toward the position shown in FIG. 15. When this position is reached, the circuitry of Removal Stop 285 will be actuated by the switch mechanism shown in FIG. 9. Master Control 90 will immediately reverse the direction of Motor 80 and the previously empty ball support member 11, with the most recently operative ball element 20 now mounted thereon, will be returned to the dash line position shown in FIG. 3, whereupon Master Control 90 will disable the circuitry of Arm tilt Clutch 190 and activate the circuitry of Index Clutch 205, with the result that tilt clutch solenoid 180 will retract tilt axle 179 and bevel gear 178 from meshing position and index bevel drive member 201 into firm engagement with friction cone 171.

While it should be noted that, by adding to the complexity of the circuit, it would be feasible to select the direction of indexing rotation so that any selected ball element 20 would be moved the minimum distance for installation, the advantages are believed to be outweighed by this added complexity. Therefore, at this stage, Master Control 90 will always signal Motor 80 to commence rotation in what has been designated the standard stanchion drive direction.

The pressing of button No. 5 will have set up a condition in Master Control 90 which requires matching by that index contact 222 identified with the previously designated ball support member 11 (diagonally opposite the empty arm in FIG. 1). When this match is achieved, contact base 228 will signal Master Control 90, which will immediately open the circuit of Index Clutch 205 causing index solenoid 200 to retract armature 202. At this stage, the selected ball element 20 will be in the position shown for empty ball support member 11 in FIG. 1.

Master Control 90 will now again close the circuit of Arm tilt Clutch 190 with resultant operation of tilt clutch solenoid 180 to bring tilt bevel gear 178 into meshing relationship with tilt bevel drive gear 170. Master Control 90 will also again initiate rotation of Motor 80 in the standard stanchion drive direction. In addition, Master Control 90 will activate the circuit of Install Stop 300. Thereupon, ball element No. 5 will be tilted toward the position shown in FIG. 14 (*c*). When the switch mechanism of FIG. 8 senses that the desired position has been reached, a signal will be sent to Master Control 90 and Master Control 90 will again reverse the direction of operation of Motor 80 to withdraw the now empty ball support member 11 (which previously carried ball No. 5) to the position shown in FIG. 1. Finally, Master Control 90 will prepare the circuitry for the next ball element change operation.

It will now be seen that, selecting among the various concepts disclosed in U.S. Pat. No. 4,088,217 and the present disclosure, various degrees of sophistication are available in providing an organized, easily usable system of ball elements. For example, where the problem is primarily one of selecting ball elements 20 quickly and efficiently from among a group and installing or removing them from the typewriter with precision and with no lost manual motion, a suitable rack (not comprising a part of the invention) may be provided on which is hung the various ball elements each supported from a ball support member 11 but, for example, having a ring at the top adapted to be supported from a selected hook on the rack. Each ball element 20 can be visually identified on the rack for quick identification. The empty ball support member 11 corresponding to the ball element 20 in use, would hang on its appropriate hook. When a change of ball elements 20 is desired, the operator would first withdraw the empty ball support member 11, project it downwardly firmly into the ball element 20 then in use until the position shown in FIG. 15 is achieved. The ball support member 11, now carrying its associated ball element 20, would be returned to its hook. The next ball element 20 would then be selected by withdrawing its ball support member 11 from its hook. The ball support member 11 would be thrust lightly down toward stud 21 until the ball element 20 snaps into engagement with stud 21 as shown in FIG. 14 (*c*). The empty ball support member 11 would be returned to its hook, thus completing the ball change.

I claim:

1. A type element for use in a single element typewriter comprising a ball shaped printing component having a flat top surface, a ball cap secured to said top surface, a pair of ball engagement elements mounted in a guide cavity within said ball cap and movable toward and away from each other, spring means for biasing said ball engagement elements toward each other, a radially inwardly extending surface on each ball engagement element which can bear against and be moved radially outwardly by an operating probe movable into and out of said guide cavity from a position above the ball element, and a radially inwardly extending gripping member on each ball engagement element for gripping a grooved portion of a standard typewriter ball element stud to secure the type element in operative position.

2. A type element according to claim 1, including a guide member slidably interconnecting said ball engagement elements and operable in recesses in a wall of said ball cap for preserving fixed relationship between said ball engagement elements.

3. A type element installation and removal mechanism for use with ball-type elements of a single element typewriter having a grooved typing element support stud which is gripped by a gripping device on a ball element when in operative position, comprising a unitary ball support member having means thereon for grasping and withdrawing the ball element from operative position, including a projecting structure forming an integral part of said unitary ball support member one portion of which is operative for effecting release of said gripping device to permit such withdrawal, another portion of said projecting structure being operative when the ball element in the grasp of the ball support member is moved toward the stud by the ball support member to actuate said gripping device for effecting said gripping of the stud to insert the ball element thereon.

4. Mechanism according to claim 3, wherein said projecting structure comprises a tip portion and diametrically opposed activating projections spaced a predetermined distance from said tip portion, and said ball element has a guide cavity therein and an opening in the top thereof shaped to permit entry of said ball support member into the cavity, including on the ball element a pair of ball engagement elements positioned within said guide cavity for controlled movement toward and away from each other, means biasing said ball engagement elements toward each other, and a follower projection on each ball engagement element extending radially inwardly for engaging and being moved radially outwardly by an activating projection of the ball support member as said ball support member moves into the cavity, the grasping of the ball element by the ball support member being effected by holding means, and the relative strength of said holding means and said biasing means being selected and the spacing and shape of said follower projections and activating projections being selected so that an operative ball element will be removed by insertion of the ball support member to a position in the ball element cavity limited by the stud, and a ball element will be installed on a vacant stud by insertion of the ball support member only a predetermined shorter distance into the ball element cavity.

5. Mechanism according to claim 4 wherein said holding means comprises a magnetic device.

6. A method for automatic installation and removal of a typing element of the ball type for a single element typewriter, which comprises initiating an element change cycle by traversing a ball support mechanically in a linear transverse direction along the typewriter to a position in alignment with the position of an operative ball element, utilizing the final phase of linear transverse movement to initiate mechanical removal of the operative ball element, utilizing the final phase of ball element removal movement for initiating mechanical indexing of the ball support to place another selected ball element in position to replace the removed ball element, utilizing the final phase of the indexing movement for initiating mechanical installation of the selected ball element in typing position, and utilizing the final phase of the ball element installation movement for initiating movement of the ball support to a position clear 7. A device for changing ball elements on a typewriter of the moving ball type comprising a movable assembly of ball elements normally supporting a plurality of said ball elements in an inoperative position clear of the typing area, motive means for traversing said assembly of ball elements in a linear direction transverse to the typewriter to a selected typing position, pivot means responsive to termination of the traversing movement for mechanically actuating an empty ball support member to remove a ball element from an operative position on the typewriter and to return said ball support member and removed ball element to said inoperative position, indexing mechanism responsive to termination of said ball element removal operation for mechanically moving another selected ball element into position for installation in said operative position, and means responsive to termination of said indexing movement for again operating said pivot means to install said selected ball element in the operative position and then return the empty ball support member on which said ball element had been mounted to said inoperative position.

* * * * *